United States Patent [19]

Weisner

[11] Patent Number: 4,470,230

[45] Date of Patent: Sep. 11, 1984

[54] SKYLIGHT AND CURB THEREFOR

[76] Inventor: Kent A. Weisner, 771 Dommerich Dr., Maitland, Fla. 32751

[21] Appl. No.: 426,800

[22] Filed: Sep. 29, 1982

[51] Int. Cl.[3] ..... E04B 7/18

[52] U.S. Cl. ..... 52/200; 206/509; 52/173 R

[58] Field of Search ..... 52/200, 72, 173 R, 224; 206/573, 509

[56] References Cited

U.S. PATENT DOCUMENTS

| | | | |
|---|---|---|---|
| 3,207,461 | 9/1965 | Holzwarth et al. | 206/509 |
| 3,399,500 | 9/1968 | Shapiro | 52/200 |
| 3,480,195 | 11/1969 | Koboldt | 206/509 |
| 3,987,930 | 10/1976 | Fuson | 206/509 |
| 4,223,493 | 9/1980 | Moench et al. | 52/200 |
| 4,242,849 | 1/1981 | Benkelman et al. | 52/200 |
| 4,281,488 | 8/1981 | Resibois | 52/173 R |
| 4,296,578 | 10/1981 | Keckamn | 52/200 |

FOREIGN PATENT DOCUMENTS

| | | | |
|---|---|---|---|
| 554488 | 2/1957 | Belgium | 52/94 |
| 6613896 | 9/1966 | Netherlands | 52/200 |
| 106809 | 6/1965 | Norway | 52/200 |

*Primary Examiner*—John E. Murtagh
*Assistant Examiner*—Andrew Joseph Rudy
*Attorney, Agent, or Firm*—William M. Hobby, III

[57] ABSTRACT

A prefabricated skylight support curb is formed to be a protective packaging for the skylight during shipment and then to be used as a curb for mounting the skylight on a roof. A prefabricated skylight support curb for supporting a skylight thereover has a bottom flange angled, upright sides, and a top lip round the top of the sides forming an opening through the curb. A skylight is adapted to cover the opening through the skylight support curb when installed, and has a domed portion and an angled curb portion extending from the dome portion and a drip edge on the curb portion. The skylight curb portion is shaped to fit over a portion of the prefabricated skylight support curb angled upright portion and top lip. The skylight support curb is shaped to nest an accompanying skylight therein having the skylight curb portion adjacent to the interior of the skylight support curb angled upright walls to protect the skylight during shipping and storing.

4 Claims, 6 Drawing Figures

SKYLIGHT AND CURB THEREFOR

BACKGROUND OF THE INVENTION

The present invention relates to skylights and to prefabricated skylight curbs for mounting the skylight, and especially to a skylight and skylight curb in which the skylight curb forms a protective support for the skylight during shipping and storage.

In the past, it has been common to provide a wide variety of skylights for mounting to the roof or side of buildings for allowing the entrance of light into a building and allowing visibility through the skylights, while blocking the escape of heat into or from the building. Typical prior art skylights are made in a self flashing model, in which a wide flange is placed around the skylight dome for attaching the skylight to an opening in a roof or wall and then roofing over the flashing to prevent leakage into the skylight roof opening. A second type of skylight is the curb mounted model in which a built-up curb is formed around the opening in a roof and the skylight has an overlapping curb built around the edges of the dome, which can be placed over the built up curb and attached thereto to prevent leakage through the roof.

The present invention relates to skylights having built in curbs for installation with a prefabricated fiberglass reinforced polymer curb for replacing the normal custom built up curb around an opening in the roof. The prefabricated curb has flashing therearound for the attachment of the flashing to the roof in a manner that the roofing can extend over the flashint to prevent leakage. The present invention is especially concerned with a prefab curb which operates in connection with a curb mounted skylight which can be easily nested within the prefabricated curb to protect the skylight dome during shipment and storage while reducing the size and weight of the shipping container.

SUMMARY OF THE INVENTION

A prefabricated skylight curb and curb mounted skylight are provided in which a molded skylight support curb has a prefabricated skylight support curb for supporting a skylight thereover and has a bottom flashing and angled upright sides and a top lip around the sides forming an opening through the curb. A curb mounted skylight is adapted to cover the opening through the skylight support curb and has a dome portion, along with an angled curb portion extending from the dome portion and a drip edge on the curb portion. The skylight curb portion is shaped to fit over a portion of the skylight's support curb angled upright portion and top lip. The skylight support curb is shaped to nest the skylight therein having the skylight curb portion adjacent the interior of the skylight support curb angled upright walls to protect the skylight during shipping and storage. The skylight drip edge is shaped to engage the bottom of the skylight support curb bottom flange when nesting therein and a plurality of nesting skylights and skylight support curbs protects each of the skylights with each skylight drip edge engaging the bottom flashing of each skylight. Each prefabricated skylight support curb has covered sealing adhesive on the top of the lip, which further supports each skylight during shipping and precut foamed insulation can be shipped between skylights in a nested group of skylights.

BRIEF DESCRIPTION OF THE DRAWINGS

Other objects, features and advantages of the present invention will be apparent from the written description and the drawings, in which.

DESCRIPTION OF THE PREFERRED EMBODIMENT

Figure 1:
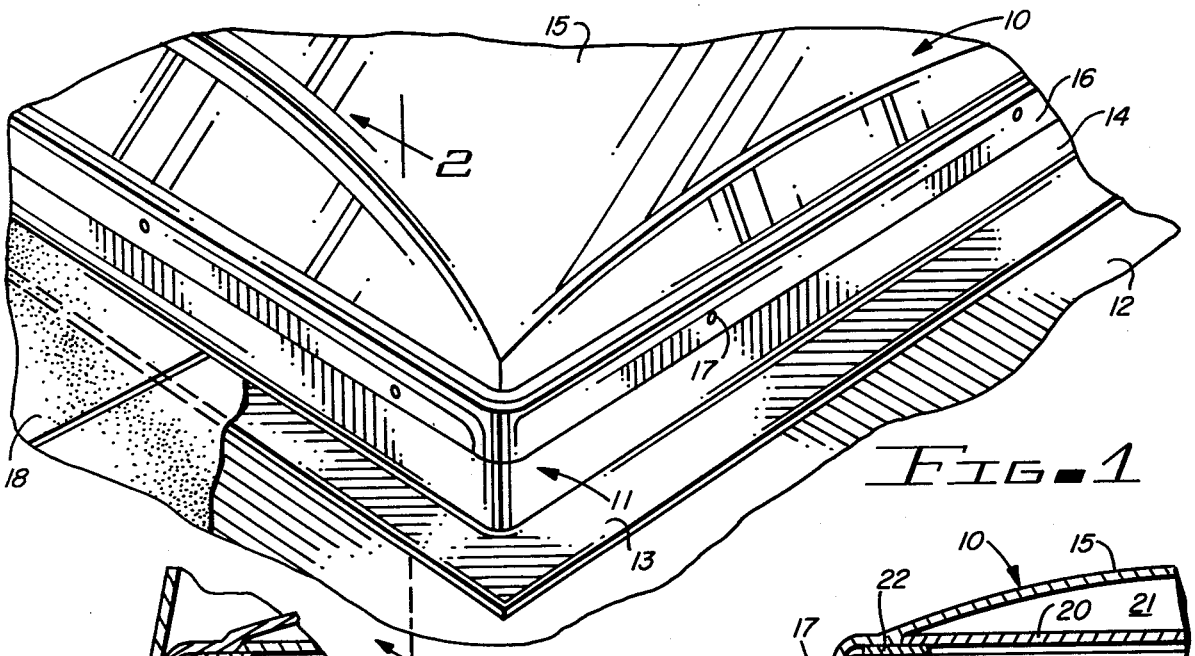
FIG. 1 is a partial perspective view of a skylight mounted on a prefabricated skylight curb in accordance with the present invention.

Referring to FIG. 1 of the drawings, a curb mounted skylight 10 as used in accordance with a present invention is shown attached to a prefabricated fiberglass reinforced polymer roof curb 11, mounted to a roof 12, and having the flashing 13 around the perimeter thereof. The prefabricated curb 11 has angled upright walls 14 having the skylight 10 mounted over a portion thereof. The skylight 10 has a dome portion 15, skylight curb portion 16 mounted with screws 17 which have insulating washers thereunder to prevent leakage through the curb portion 16 and which are driven into the wall 14 of the prefabricated curb 11. Roofing shingles 18 can be seen mounted over the flashing 13 of the prefabricated curb 11.

Figure 2:
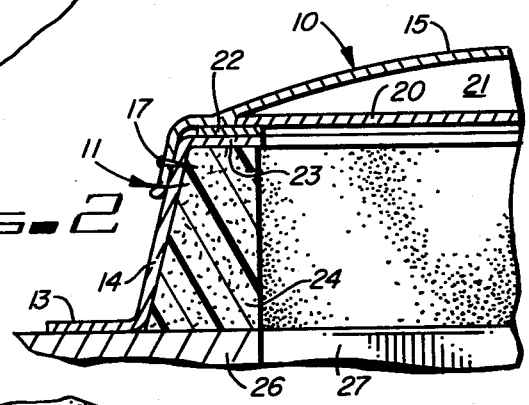
FIG. 2 is a sectional view taken on the line 2—2 of FIG. 1.

In FIG. 2, the skylight 10 can be seen as having an insulating layer 20 to form an insulating space 21, but it will of course, be clear that additional layers can add additional insulation value to the skylight without departing from the spirit and scope of the invention. A sealant adhesive 22 is shown along a top lip 23 of the prefabricated curb 11. The curb 11 is shipped with the sealant 22 already applied and covered with a protective cover, such as waxed paper, which can be peeled off when the skylight 10 is ready to be attached to form a seal between the skylight 10 and the prefabricated curb 11. A foamed polymer insulation 24 or fiberglass insulation which may be included or be supplied by others and attached along the inside of wall 14 of the prefabricated curb 11 just over the roof 26. The wall is then finished off along the inside of the insulation 24 to have a finished and installed skylight. The wall 27 in this view forms a roof opening into the building.

Figure 3:
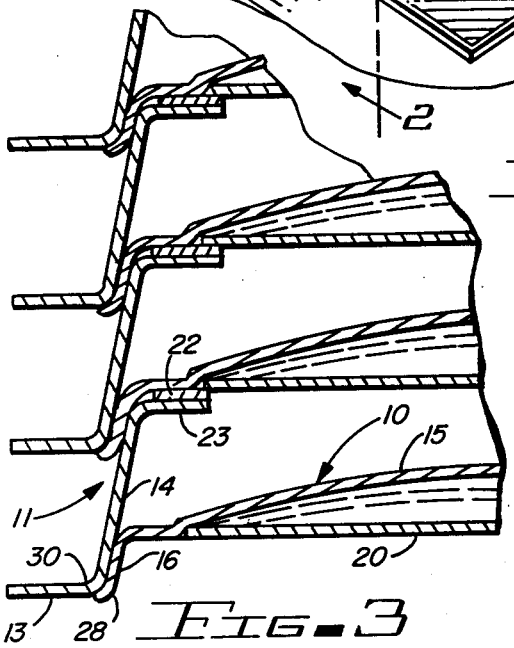
FIG. 3 is a partial sectional view of a plurality of nested prefabricated curbs and skylights.

FIG. 3 shows how the skylight 10 can be placed inside the bottom of the prefabricated curb 11 with the wall 16 of the skylight positioned against an interior of the prefabricated curb wall 14 and a drip edge 28 resting against the curb portion 30 of the flashing 13 of the prefabricated curb. The domed skylight 10 has a dome 15 which falls below the lip 23 of the curb 11 so that when packed, as shown in the bottom curb of FIG. 3, the prefabricated curb and the skylight can be packed in a container with the prefabricated curb 11 acting as the packing and bracing for the skylight 10 to protect the dome 15 of the skylight from damage. This provides a much more ridgid protection than might be provided with other packing material and in addition, reduces the size of the shipping container and the weight required for the additional packing to protect the skylight 10. In addition, a packing container may be used having angled sides to protect against the angled prefabricated curb sides thereby conserving space and shipping costs.

As shown in FIG. 3, the prefabricated curb 11 is further designed so that a plurality of the curbs can be nested on top of each other with their respective skylights 10 mounted therein. Each support curb 11 is supported by the skylight lip 23, while the skylight 10 is supported by the curb lip 23 and covered adhesive 22 and by the skylight sides 16 adjacent to the prefabricated curb sides 14. Additional foamed polymer support may be placed between the bottom of the lip 23 and the top of the horizontal flanges 14 dome 15 to further cushion the skylights during shipping.

Figure 4:
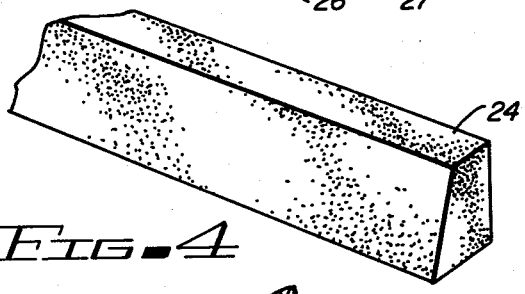
FIG. 4 is a partial perspective of prefabricated insulation for the prefabricated curb.
Figure 6:
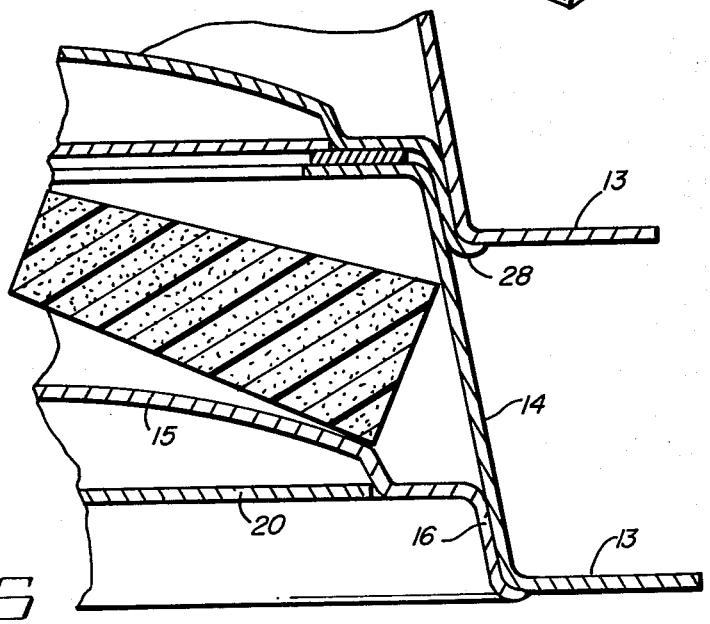
FIG. 6 is a partial sectional view of a pair of nested curbs, skylights and prefabricated insulation packed therein.

FIG. 4 shows a strip of the prefabricated and cut foamed polymer insulation 24, which may be a polystyrene, or the like, and which may be stored when shipping a plurality of prefabricated curbs and skylights, as shown in FIG. 6, placed sideways between adjacent pairs of skylights 10. For installation, the foamed insulation or fiberglass insulation 25 can be removed and attached or inserted as shown in FIG. 2.

Figure 5:
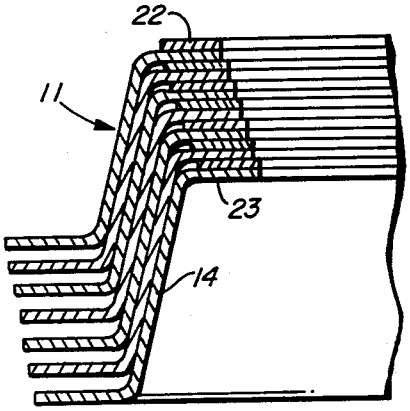
FIG. 5 is a partial sectional view of a group of nested prefabricated curbs.

FIG. 5 shows that the prefabricated curbs 11 have also been designed so that they can be nested in a stack without the skylights, each slightly spaced along the top lip 23 by the adhesive sealant 22 and needs supported by the adjacent angled sides 14.

It should be clear at this point that a prefabricated skylight curb has been provided which can be molded with fiberglass reinforced polymers for ready installation on a building to eliminate the need for building a custom curb from wood and flashing or aluminum welded together, which often times leaks. The prefabricated curb has ready-made flashing for the attachment to a roof and being fabricated in one piece eliminates potential leaks. It should also be clear that the prefabricated curb is designed specifically with a matching curb mounted skylight for ready attachment thereto, which is also designed to fit inside the bottom of the prefabricated curb with a drip edge engaging the corner of the flashing of the prefabricated curb to protect the polymer skylight from becoming scratched or damaged during shipment or storage and the prefabricated curb for rapid installation with insulation without the need for an installer to find, cut and install the insulation.

It should also be clear, however, that the present invention is not to be considered as being limited to the forms shown, which are to be considered illustrative rather than restrictive.

I claim:

1. A skylight curb and skylight comprising in combination:

a prefabricated skylight support curb for supporting a skylight thereover having a bottom flashing therearound, angled upright sides and a top lip around the upright sides forming an opening through the curb;

a skylight adapted to cover the opening through the prefabricated skylight support curb and having a shaped dome portion and an angled curb portion extending from the dome portion and said angled curb portion having a drip edge and being shaped to fit over a portion of said prefabricated skylight support curb, angled upright portion and top lip;

said prefabricated skylight support curb being shaped to nest said skylight therein having the skylight curb portion adjacent the skylight support curb angled upright walls to protect the skylight during shipping and storage, whereby the prefabricated curb serves as a shipping container and curb;

a drip edge shaped to engage the bottom of said prefabricated skylight support curb flashing when nested therein; and a plurality of nesting support curbs, each having a nested skylight therein and each skylight having a skylight drip edge engaging the skylight support curb flashing.

2. A skylight curb and skylight in accordance with claim 1, in which each prefabricated support curb has a sealant adhesive along the top of the top lip thereof having a peel off cover thereover and positioned to support the next adjacent skylight in a nested plurality of skylights.

3. A skylight curb and skylight in accordance with claim 1, in which prefabricated foamed polymer insulation has been cut and shaped to fit the prefabricated skylight support curb angled upright sides to form an insulation barrier therearound.

4. A skylight curb and skylight in accordance with claim 3, in which said prefabricated insulation is shaped to fit between skylights in a nested group of prefabricated skylight support curbs and skylights.

* * * * *